US008292114B1

(12) United States Patent
Tabele, Jr.

(10) Patent No.: US 8,292,114 B1
(45) Date of Patent: Oct. 23, 2012

(54) SECURING DEVICE FOR GARBAGE BAGS IN RECEPTACLES

(76) Inventor: William T. Tabele, Jr., Bradenton, FL (US)

( * ) Notice: Subject to any disclaimer, the term of this patent is extended or adjusted under 35 U.S.C. 154(b) by 120 days.

(21) Appl. No.: 12/797,892

(22) Filed: Jun. 10, 2010

(51) Int. Cl.
*B65D 35/14* (2006.01)
*B65D 90/00* (2006.01)

(52) U.S. Cl. ..... 220/495.08; 220/495.11; 220/908.1

(58) Field of Classification Search ..... 220/495.08, 220/495.11, 908.1, 910; 248/99, 101
See application file for complete search history.

(56) References Cited

U.S. PATENT DOCUMENTS 3,893,615 A * 7/1975 Johnson ..... 232/43.2
4,765,579 A 8/1988 Robbins, III et al.
4,923,087 A 5/1990 Burrows
5,209,442 A 5/1993 Buck et al.
5,269,435 A 12/1993 Hallock, III
D355,511 S 2/1995 Cassel
5,645,186 A 7/1997 Powers et al.
5,735,495 A 4/1998 Kubota
7,182,215 B1 * 2/2007 Clardy ..... 220/287
7,404,499 B1 7/2008 Ramsey
2008/0191103 A1 * 8/2008 Thurgar ..... 248/101

* cited by examiner

*Primary Examiner* — Harry Grosso

(57) ABSTRACT

A securing device for securing a garbage bag in a garbage receptacle featuring an elongated U-shaped base bar having a front panel and a back panel connected via a connector segment, the base bar is adapted to snugly wrap over a top edge of the garbage receptacle simultaneously sandwiching the garbage bag; an anchor component with a first attachment means for securing the anchor component to the garbage receptacle; and a cord connecting the anchor component and the base bar.

15 Claims, 5 Drawing Sheets

SECURING DEVICE FOR GARBAGE BAGS IN RECEPTACLES

FIELD OF THE INVENTION

The present invention is directed to garbage receptacle accessories, more particularly to a device for securing a garbage bag within the receptacle.

BACKGROUND OF THE INVENTION

Most garbage bags are designed to loosely fit into a garbage receptacle. Without a snug fit, the bags may slip and spills can occur, for example between the bag and the receptacle. The present invention features a securing device for securing garbage bags in place within a receptacle. The device of the present invention secures the garbage bag quickly and easily, and the device can be used with many different types of receptacles (e.g., those with or without upper edge lips). Removal of the device of the present invention is easy, and anchor components help prevent the device from being misplaced. The device can be attached to the receptacles easily, and the device can be adapted for industrial, commercial, and residential use.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
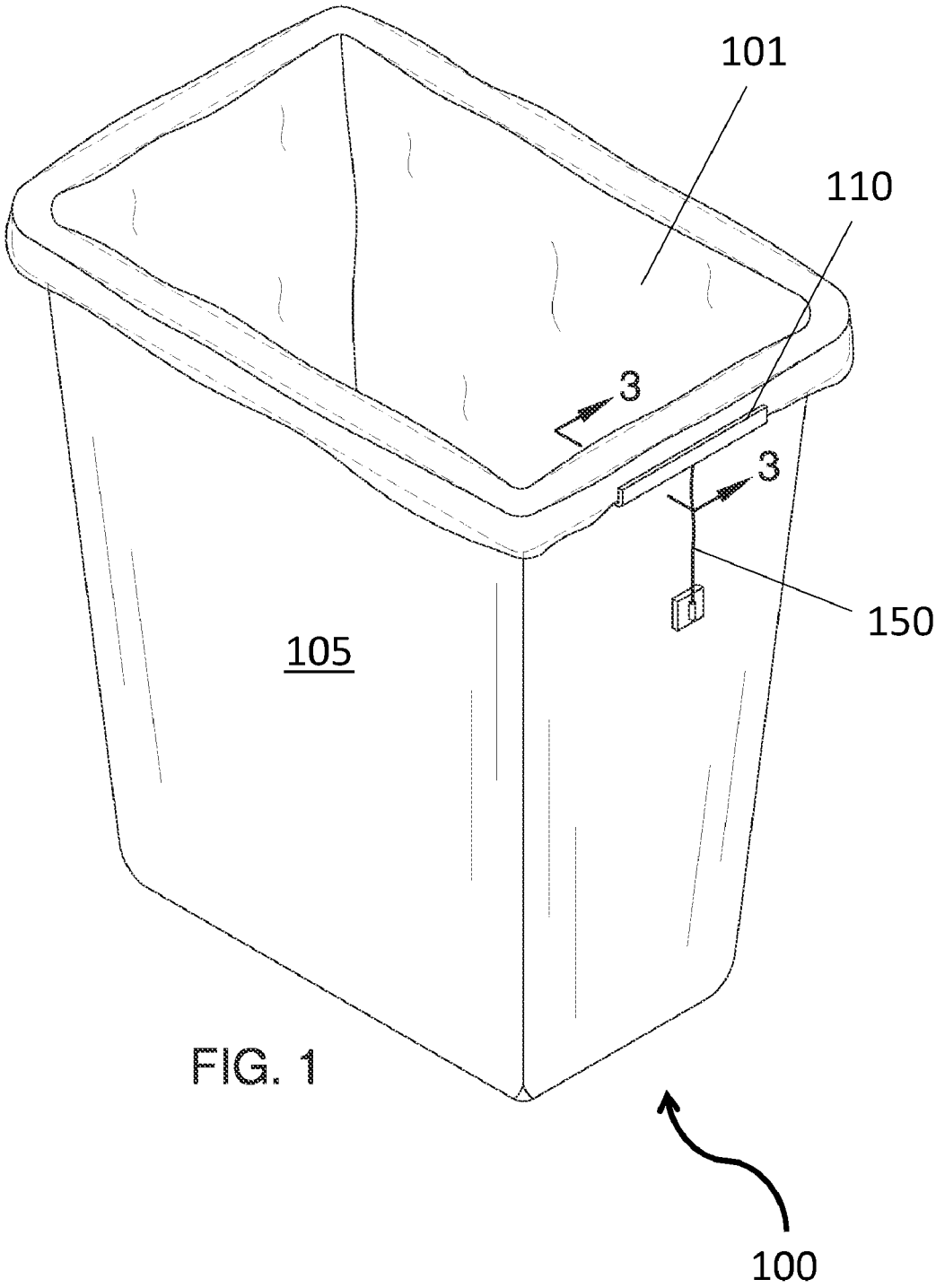
FIG. 1 is an in-use view of the securing device of the present invention, wherein the garbage receptacle has a lip.
Figure 2:
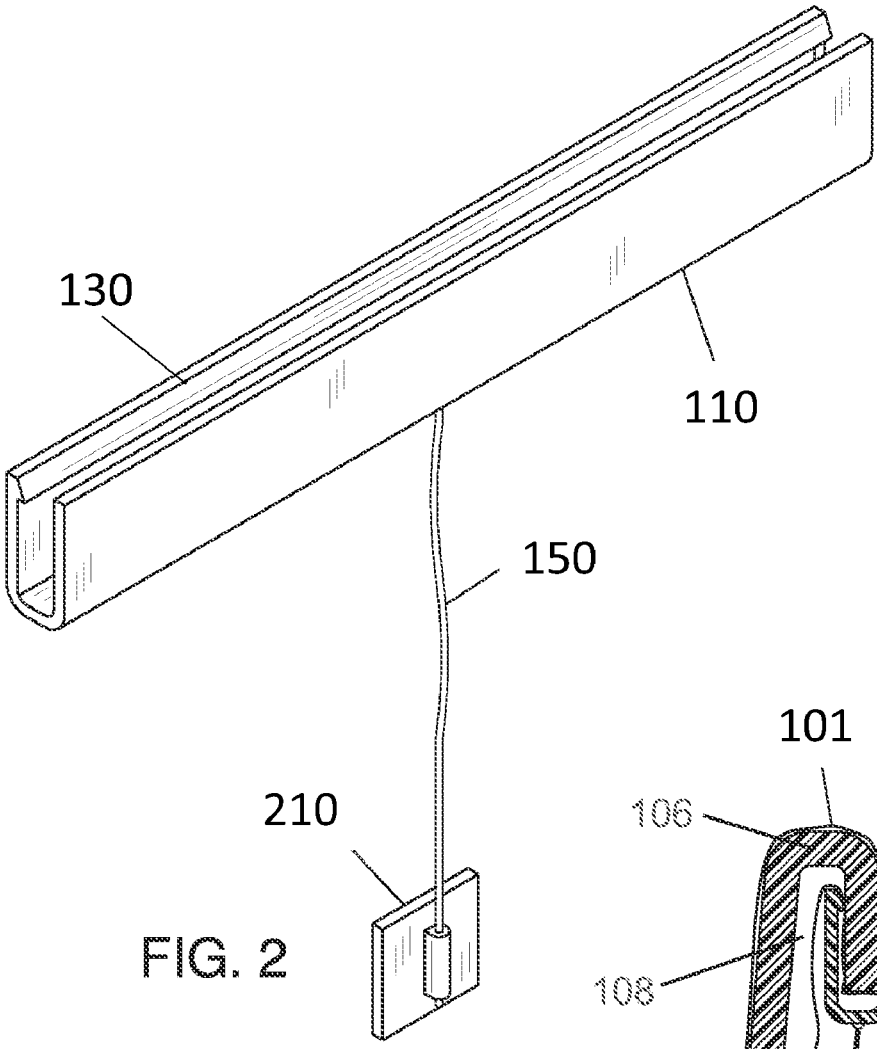
FIG. 2 is a perspective view of the securing device of the present invention.
Figure 3:
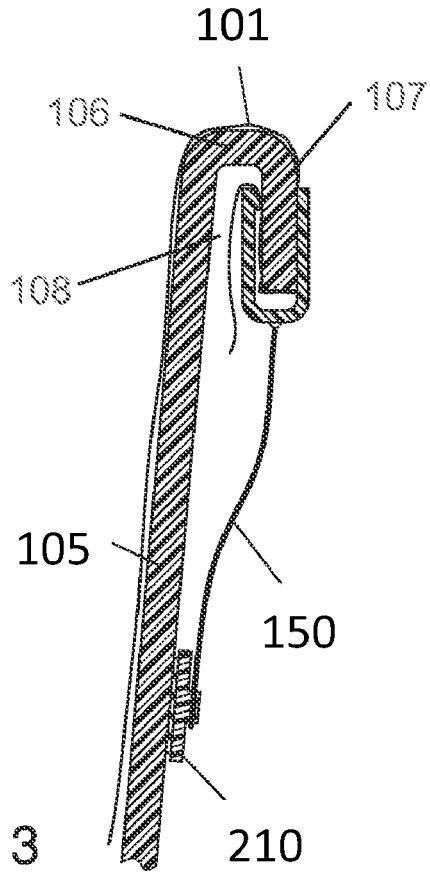
FIG. 3 is a cross sectional view of the securing device of FIG. 2.
Figure 4:
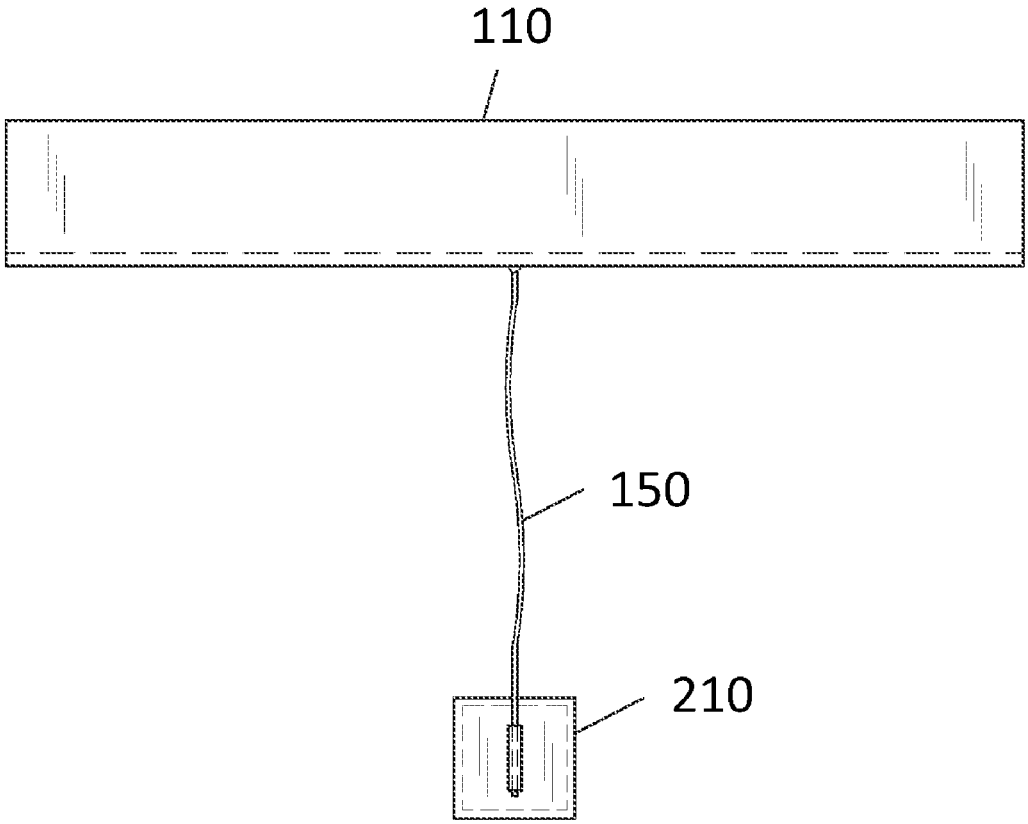
FIG. 4 is a front view of the securing device of FIG. 2.
Figure 5:
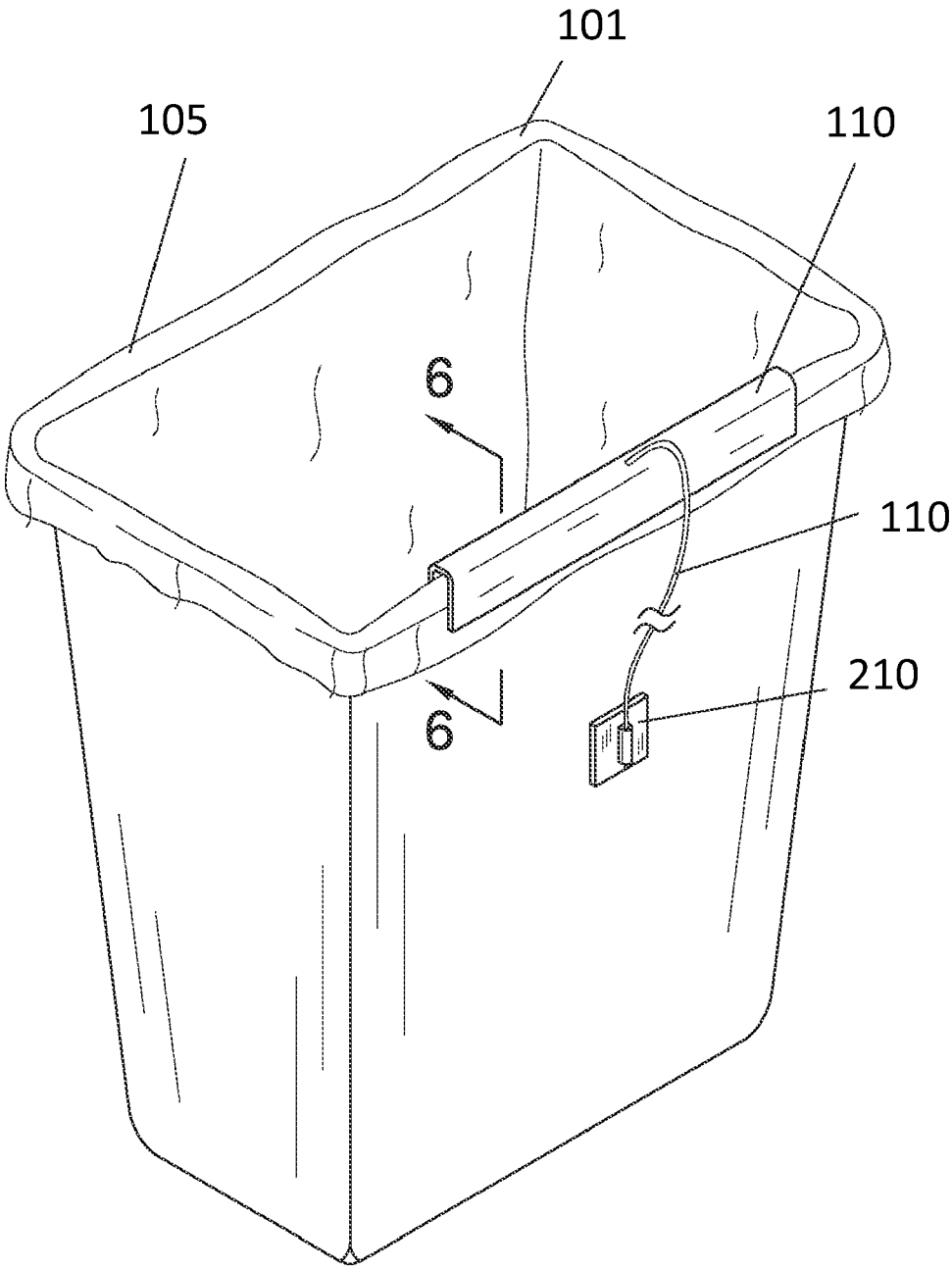
FIG. 5 is an in-use view of the securing device of the present invention, wherein the garbage receptacle does not have a lip.
Figure 7:
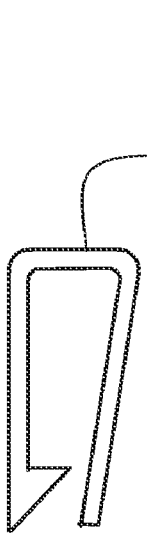
FIG. 7 is a side view of the securing device of FIG. 5.
Figure 6:
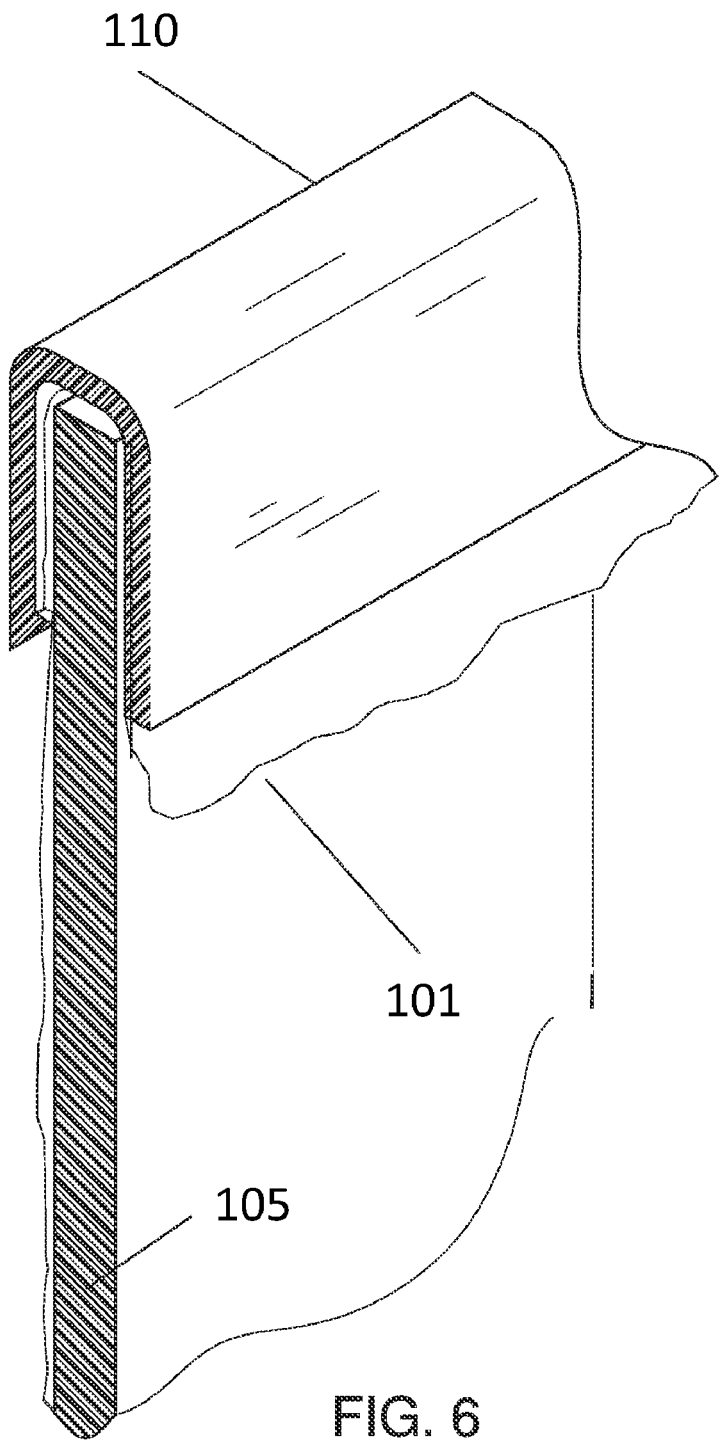
FIG. 6 is a perspective and cross sectional view of the securing device of FIG. 5.

Referring now to FIGS. 1-7, the present invention features a securing device 100 for securing a garbage bag 101 in place within a garbage receptacle 105 (see FIG. 1). The device 100 comprises an elongated U-shaped base bar 110 having a front panel and a back panel each having a top edge, a first side edge, a second side edge, and a bottom edge. The top edges of the panels are connected via a connector segment (e.g., the front panel, back panel, and connector segment form the U-shape, as shown in FIG. 2 and FIG. 3). The base bar 110 is adapted to snugly wrap over the top edge of the garbage receptacle 105 if the garbage receptacle 105 does not have a lip (e.g., see FIG. 5) or snugly wrap over the lip of the top of the garbage receptacle 105 if the receptacle has a lid (see FIG. 1), simultaneously sandwiching the garbage bag 101. As shown in FIG. 2, a rim 130 is disposed on the bottom edge of the front panel. The rim 130 can help secure the base bar 110 in place when attached to the garbage receptacle 105.

The device 100 of the present invention further comprises an anchor component 210 attachable to the garbage receptacle 105. For example, a first attachment means is disposed on the anchor component 210 functioning to secure the anchor component 210 to the garbage receptacle. In some embodiments, the attachment means is an adhesive mechanism, a snap mechanism, a magnet mechanism, a hook-and-loop fastener mechanism, a clamp mechanism, the like, or a combination thereof.

Disposed on the anchor 210 is a cord 150 having a first end and a second end. The first end of the cord 150 is attached to the anchor 210 and the second end of the cord 150 is attached to the base bar 110. In some embodiments, the cord 150 is between about 1 to 2 inches in length as measured from the first end to the second end. In some embodiments, the cord 150 is between about 2 to 4 inches in length as measured from the first end to the second end. In some embodiments, the cord 150 is more than about 4 inches in length.

The base bar 110 may be constructed in a variety of sizes to accommodate various sizes of garbage receptacles 105. In some embodiments, the base bar 110 is between about 1 to 2 inches in length as measured from the first side edge of the front panel to the second side edge of the front panel. In some embodiments, the base bar 110 is between about 2 to 4 inches in length as measured from the first side edge of the front panel to the second side edge of the front panel. In some embodiments, the base bar 110 is more than about 4 inches in length.

Without wishing to limit the present invention to any theory or mechanism, it is believed that the securing device 100 of the present invention is advantageous because it is constructed from flexible materials, which ensures durability. And, the anchor components 150 help prevent the device 100 from being misplaced.

The present invention also features a modified garbage receptacle comprising a garbage receptacle (e.g., a standard receptacle) with the securing device 100 of the present invention incorporated into the design (e.g., during the production process).

The present invention also features a kit comprising two or more securing devices 100 of the present invention. In some embodiments, the kit further comprises a garbage receptacle 105. The garbage has a top rim 106, wherein the top rim consisting of a downwardly turned edge 107 surrounding the top rim, wherein the downwardly turned edge forms a cavity 108 between the edge and exterior surface of the garbage receptacle. The base bar 110 is adapted to snugly wrap over the tip of the top of the garbage receptacle 105 (see FIG. 1), simultaneously sandwiching the garbage bag 101, the base bar 110 is adapted to snugly wrap over the downwardly turned edge 107 of the garbage 105 receptacle simultaneously sandwiching the garbage bag 101, wherein the front panel with rim is disposed inside the said cavity.

As used herein, the term "about" refers to plus or minus 10% of the referenced number. For example, an embodiment wherein the cord 150 is about 4 inches in length includes a cord 150 that is between 3.6 and 4.4 inches in length.

The following disclosures of the following U.S. patents are incorporated in their entirety by reference herein: U.S. Pat. No. 5,645,186; U.S. Pat. No. 5,735,495; U.S. Pat. No. 4,923,087; U.S. Pat. No. 4,765,579; U.S. Pat. No. 5,209,442; U.S. Pat. No. 5,269,435; U.S. Pat. No. 7,404,499.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A kit comprising a garbage receptacle and two or more securing devices for securing a garbage bag in the garbage receptacle, each securing device consisting of:

(a) the garbage receptacle with a top rim, wherein the top rim consists of a downwardly turned edge surrounding the top rim, wherein the downwardly turned edge forms a cavity between the edge and exterior surface of the garbage receptacle;

(b) an elongated U-shaped base bar of more than 4 inches in length having a front panel and a back panel connected via a connector segment, said front panel comprising a rim disposed on a bottom edge, the base bar is adapted to snugly wrap over the downwardly turned edge of the garbage receptacle simultaneously sandwiching the garbage bag, wherein the front panel with rim is disposed inside the said cavity;

(c) an anchor component with a first attachment means for securing the anchor component to the garbage receptacle; and (d) a cord having a first end and a second end, the first end of the cord being attached to the anchor component and the second end of the cord being attached to the base bar.

2. The device of claim 1, wherein the base bar is between about 2 to 4 inches in length as measured from the first side edge of the front panel to the second side edge of the front panel.

3. The device of claim 1, wherein the attachment means includes an adhesive mechanism, a snap mechanism, a magnet mechanism, a hook-and-loop fastener mechanism, a clamp mechanism, or a combination thereof.

4. The device of claim 1, wherein the cord is between about 1 to 2 inches in length as measured from the first end to the second end.

5. The device of claim 1, wherein the cord is between about 2 to 4 inches in length as measured from the first end to the second end.

6. A securing device for securing a garbage bag in a garbage receptacle, said securing device consisting of:

(a) an elongated U-shaped base bar having a front panel and a back panel connected via a connector segment, said front panel comprising a rim disposed on a bottom edge, a garbage receptacle with a top rim, wherein the top rim consists of a downwardly turned edge surrounding the top rim, wherein the downwardly turned edge forms a cavity between the edge and exterior surface of the garbage receptacle, wherein the base bar is adapted to snugly wrap over the downwardly turned edge of the garbage receptacle simultaneously sandwiching the garbage bag, wherein the front panel with rim is disposed inside the said cavity;

(b) an anchor component with a first attachment means for securing the anchor component to the garbage receptacle; and (c) a cord having a first end and a second end, the first end of the cord being attached to the anchor component and the second end of the cord being attached to the base bar.

7. The device of claim 6, wherein the base bar is between about 2 to 4 inches in length as measured from the first side edge of the front panel to the second side edge of the front panel.

8. The device of claim 6, wherein the attachment means includes an adhesive mechanism, a snap mechanism, a magnet mechanism, a hook-and-loop fastener mechanism, a clamp mechanism, or a combination thereof.

9. The device of claim 6, wherein the cord is between about 1 to 2 inches in length as measured from the first end to the second end.

10. The device of claim 6, wherein the cord is between about 2 to 4 inches in length as measured from the first end to the second end.

11. A modified garbage receptacle consisting of:

(a) a garbage receptacle with a top rim, wherein the top rim consists of a downwardly turned edge surrounding the to rim, wherein the downwardly turned edge forms a cavity between the edge and exterior surface of the garbage receptacle; and (b) at least one securing device for securing a garbage bag in the garbage receptacle, said securing device comprising:

(i) an elongated U-shaped base bar having a front panel and a back panel connected via a connector segment, said front panel comprising a rim disposed on a bottom edge, the base bar is adapted to snugly wrap over the downwardly turned edge of the garbage receptacle simultaneously sandwiching the garbage bag, wherein the front panel with rim is disposed inside the said cavity;

(ii) an anchor component attached to the garbage receptacle via a first attachment means; and (iii) a cord having a first end and a second end, the first end of the cord being attached to the anchor component and the second end of the cord being attached to the base bar.

12. The device of claim 11, wherein the base bar is between about 2 to 4 inches in length as measured from the first side edge of the front panel to the second side edge of the front panel.

13. The device of claim 11, wherein the attachment means includes an adhesive mechanism, a snap mechanism, a magnet mechanism, a hook-and-loop fastener mechanism, a clamp mechanism, or a combination thereof.

14. The device of claim 11, wherein the cord is between about 1 to 2 inches in length as measured from the first end to the second end.

15. The device of claim 11, wherein the cord is between about 2 to 4 inches in length as measured from the first end to the second end.

* * * * *